US008011908B2

(12) United States Patent
Williamson et al.

(10) Patent No.: US 8,011,908 B2
(45) Date of Patent: Sep. 6, 2011

(54) VARIABLE CAPACITY PUMP WITH DUAL SPRINGS

(75) Inventors: Matthew Williamson, Richmond Hill (CA); Michal Nemec, Steyr (AT)

(73) Assignee: Magna Powertrain Inc, Concord (CA)

( * ) Notice: Subject to any disclaimer, the term of this patent is extended or adjusted under 35 U.S.C. 154(b) by 306 days.

(21) Appl. No.: 12/304,518

(22) PCT Filed: Jul. 6, 2007

(86) PCT No.: PCT/CA2007/001187

§ 371 (c)(1),
(2), (4) Date: Dec. 12, 2008

(87) PCT Pub. No.: WO2008/003169

PCT Pub. Date: Jan. 10, 2008

(65) Prior Publication Data

US 2009/0285707 A1 Nov. 19, 2009

(51) Int. Cl.
*F04C 2/00* (2006.01)
*F04C 14/18* (2006.01)

(52) U.S. Cl. ..... 418/26; 418/27; 418/30; 417/220

(58) Field of Classification Search ..... 418/24–27, 418/30; 417/220, 213

See application file for complete search history.

(56) References Cited

U.S. PATENT DOCUMENTS

| | | | | |
|---|---|---|---|---|
| 2,433,484 | A * | 12/1947 | Roth | 418/26 |
| 2,635,551 | A * | 4/1953 | De Lancey | 417/220 |
| 2,985,109 | A * | 5/1961 | Walter | 417/220 |
| 3,604,823 | A * | 9/1971 | Thomas | 418/26 |
| 4,496,288 | A | 1/1985 | Nakamura et al. | |
| 5,141,418 | A | 8/1992 | Ohtaki et al. | |
| 5,800,131 | A * | 9/1998 | Lehmann et al. | 417/220 |
| 7,070,399 | B2 | 7/2006 | Konishi et al. | |
| 7,794,217 | B2 * | 9/2010 | Williamson et al. | 418/26 |

* cited by examiner

*Primary Examiner* — Theresa Trieu
(74) *Attorney, Agent, or Firm* — Miller Canfield

(57) ABSTRACT

A variable capacity vane pump has a pump control ring that is moveable to alter the capacity of the pump. A control chamber is formed between the pump casing and the control ring. The control chamber is operable to receive pressurized fluid to create a force to move the control ring to reduce the volumetric capacity of the pump. A primary return spring acts between control ring and the casing to bias the control ring towards a position of maximum volumetric capacity. A secondary return spring is mounted in the casing and is configured to engage the control ring after the control ring has moved a predetermined amount. The secondary return spring biases the control ring towards a position of maximum volumetric capacity. The secondary return spring acts against the force of the control chamber to establish a second equilibrium pressure.

4 Claims, 3 Drawing Sheets

VARIABLE CAPACITY PUMP WITH DUAL SPRINGS

FIELD OF THE INVENTION

The present invention relates to variable capacity pumps. More specifically, the present invention relates to a speed-related control mechanism to control the output of a variable capacity pump.

BACKGROUND OF THE INVENTION

Pumps for incompressible fluids, such as oil, are often variable capacity vane pumps. Such pumps include a moveable pump ring, which allows the rotor eccentricity of the pump to be altered to vary the capacity of the pump.

Having the ability to alter the volumetric capacity of the pump to maintain an equilibrium pressure is important in environments such as automotive lubrication pumps, wherein the pump will be operated over a range of operating speeds. In such environments, to maintain an equilibrium pressure it is known to employ a feedback supply of the working fluid (e.g. lubricating oil) from the output of the pump to a control chamber adjacent the pump control ring, the pressure in the control chamber acting to move the control ring, against a biasing force from a return spring, to alter the capacity of the pump.

When the pressure at the output of the pump increases, such as when the operating speed of the pump increases, the increased pressure is applied to the control ring to overcome the bias of the return spring and to move the control ring to reduce the capacity of the pump, thus reducing the output volume and hence the pressure at the output of the pump.

Conversely, as the pressure at the output of the pump drops, such as when the operating speed of the pump decreases, the decreased pressure applied to the control chamber adjacent the control ring allows the bias of the return spring to move the control ring to increase the capacity of the pump, raising the output volume and hence pressure of the pump. In this manner, an equilibrium pressure is obtained at the output of the pump.

The equilibrium pressure is determined by the area of the control ring against which the working fluid in the control chamber acts, the pressure of the working fluid supplied to the chamber and the bias force generated by the return spring.

Conventionally, the equilibrium pressure is selected to be a pressure which is acceptable for the expected operating range of the engine and is thus somewhat of a compromise as, for example, the engine may be able to operate acceptably at lower operating speeds with a lower working fluid pressure than is required at higher engine operating speeds. In order to prevent undue wear or other damage to the engine, the engine designers will select an equilibrium pressure for the pump which meets the worst case (high operating speed) conditions. Thus, at lower speeds, the pump will be operating at a higher capacity than necessary for those speeds, wasting energy pumping the surplus, unnecessary, working fluid.

It is desired to have a variable capacity vane pump that can provide at least two equilibrium pressures in a reasonably compact pump housing.

SUMMARY OF THE INVENTION

It is an object of the present invention to provide a novel system and method of controlling the capacity of a variable capacity pump that obviates or mitigates at least one disadvantage of the prior art.

According to a first aspect of the present invention, there is provided a variable capacity vane pump having a pump control ring which is moveable to alter the capacity of the pump.

The pump is operable at at least two selected equilibrium pressures. The pump has a casing having a pump chamber therein. A vane pump rotor is rotatably mounted in the pump chamber. A control ring encloses the vane pump rotor within the pump chamber. The control ring is moveable within the pump chamber to alter the capacity of the pump. A control chamber is formed between the pump casing and the control ring. The control chamber is operable to receive pressurized fluid to create a force to move the control ring to reduce the volumetric capacity of the pump. A primary return spring acts between control ring and the casing to bias the control ring towards a position of maximum volumetric capacity. The primary return spring acts against the force of the control chamber to establish a first equilibrium pressure. A secondary return spring is mounted in the casing and is configured to engage the control ring after the control ring has moved a predetermined amount. The secondary return spring biases the control ring towards a position of maximum volumetric capacity. The secondary return spring acts against the force of the control chamber to establish a second equilibrium pressure.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
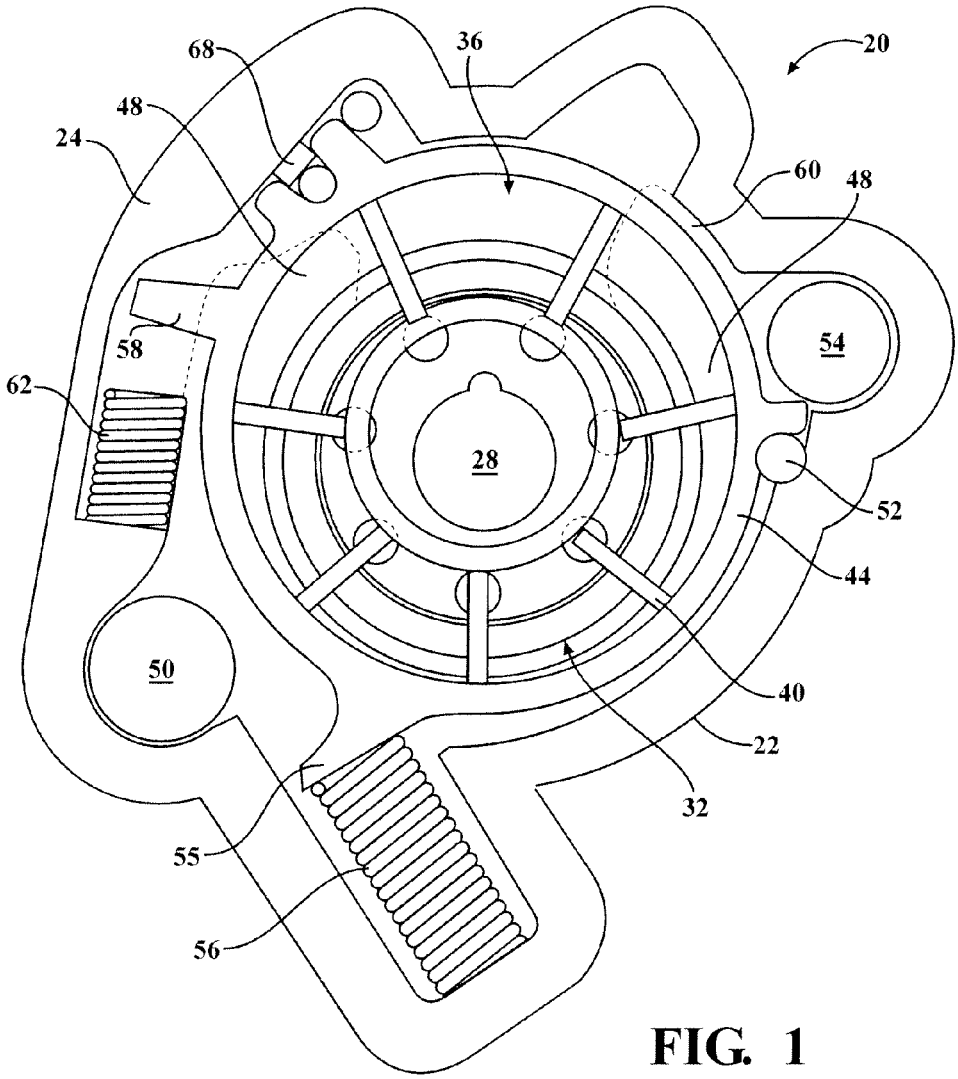
FIG. 1 shows a plan view of a variable capacity pump in accordance with the present invention.

A variable capacity vane pump in accordance with an embodiment of the present invention is indicated generally at 20 in FIG. 1. Pump 20 includes a casing 22 with a front face 24 which is sealed with a pump cover (not shown) and a suitable gasket, to an engine (not shown) or the like for which pump 20 is to supply pressurized working fluid.

Pump 20 includes a drive shaft 28 which is driven by any suitable means, such as the engine or other mechanism to which the pump is to supply working fluid, to operate pump 20. As drive shaft 28 is rotated, a pump rotor 32 located within a pump chamber 36 is driven by drive shaft 28. A series of slidable pump vanes 40 rotate with rotor 32, the outer end of each vane 40 engaging the inner circumferential surface of a pump control ring 44, which forms the outer wall of pump chamber 36 and pump chamber 36 is divided into a series of expanding and contracting working fluid or pumping chambers 48, defined by the inner surface of pump control ring 44, pump rotor 32 and vanes 40.

Pump control ring 44 is mounted within casing 22 via a pivot pin 52 that allows the center of pump control ring 44 to be moved relative to the center of rotor 32. As the center of pump control ring 44 is located eccentrically with respect to the center of pump rotor 32 and each of the interior of pump control ring 44 and pump rotor 32 are circular in shape, the volume of working fluid chambers 48 changes as the chambers 48 rotate around pump chamber 36, with their volume becoming larger at the low pressure side (the left hand side of pump chamber 36 in FIG. 1) of pump 20 and smaller at the high pressure side (the right hand side of pump chamber 36 in FIG. 1) of pump 20. This change in volume of working fluid chambers 48 generates the pumping action of pump 20, drawing working fluid from an inlet port 50 and pressurizing and delivering it to an outlet port 54.

By moving pump control ring 44 about pivot pin 52 the amount of eccentricity, relative to pump rotor 32, can be changed to vary the amount by which the volume of working fluid chambers 48 change from the low pressure side of pump 20 to the high pressure side of pump 20, thus changing the volumetric capacity of the pump. A primary return spring 56 engages tab 55 of control ring 44 and casing 22 to bias pump control ring 44 to the position, shown in FIG. 1, wherein the pump has a maximum eccentricity.

As mentioned above, it is known to provide a control chamber adjacent a pump control ring and a return spring to move the pump ring of a variable capacity vane pump to establish an equilibrium output volume, and its related equilibrium pressure.

Control chamber 60 is formed between pump casing 22, pump control ring 44, pivot pin 52 and a resilient seal 68, mounted on pump control ring 44 and abutting casing 22. In the illustrated embodiment, control chamber 60 is in direct fluid communication with pump outlet 54 such that pressurized working fluid from pump 20 which is supplied to pump outlet 54 also fills control chamber 60.

As will be apparent to those of skill in the art, control chamber 60 need not be in direct fluid communication with pump outlet 54 and can instead be supplied from any suitable source of working fluid, such as from an oil gallery in an automotive engine being supplied by pump 20.

Figure 2:
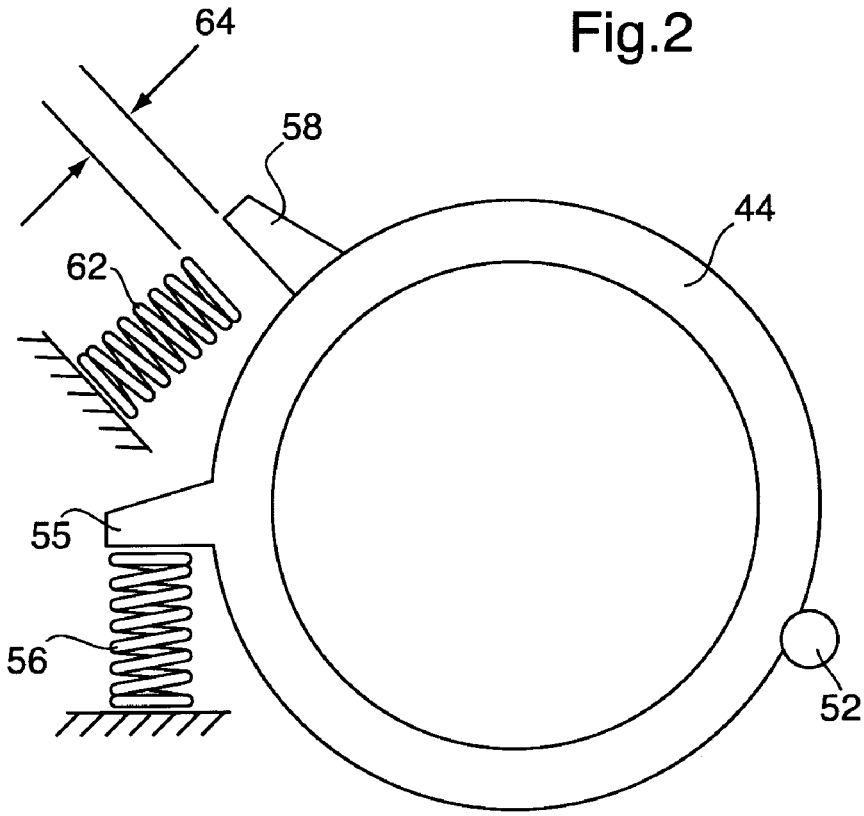
FIG. 2 shows a schematic view of control ring utilized in the variable capacity pump of FIG. 1.

Referring to FIG. 2, secondary control of the pump 20 is provided by control ring 44 having a secondary tab 58 circumferentially spaced from tab 55. Casing 22 is configured to house a secondary spring 62 in a pre-loaded state. Secondary spring 62 is a high rate spring relative to spring 56, preferably, which is a low rate spring.

Figure 3:
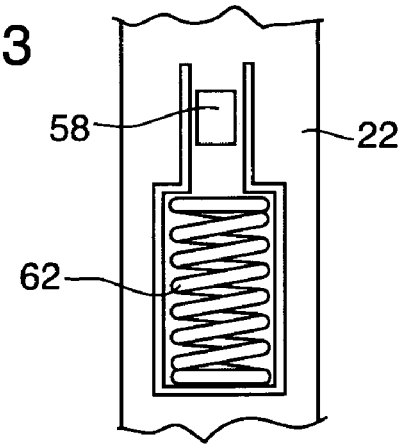
FIG. 3 shows a schematic elevational view of the secondary spring system of the variable capacity pump of FIG. 1.

Referring to FIG. 3, casing 22 is configured to house spring 62 in a pre-loaded or compressed state. Secondary tab 58 is spaced from the spring 62 by a gap 64, while the control ring 44 is in a maximum flow capacity state.

In operation, pressurized working fluid in control chamber 60 acts against pump control ring 44 and, when the force on pump control ring 44 resulting from the pressure of the pressurized working fluid is sufficient to overcome the biasing force of return spring 56, pump control ring 44 pivots about pivot pin 52, in a counter-clockwise direction on FIG. 1, to reduce the eccentricity of pump 20. When the pressure of the pressurized working is not sufficient to overcome the biasing force of return spring 56, pump control ring 44 pivots about pivot pin 52, in clockwise direction, to increase the eccentricity of pump 20.

Figure 4:
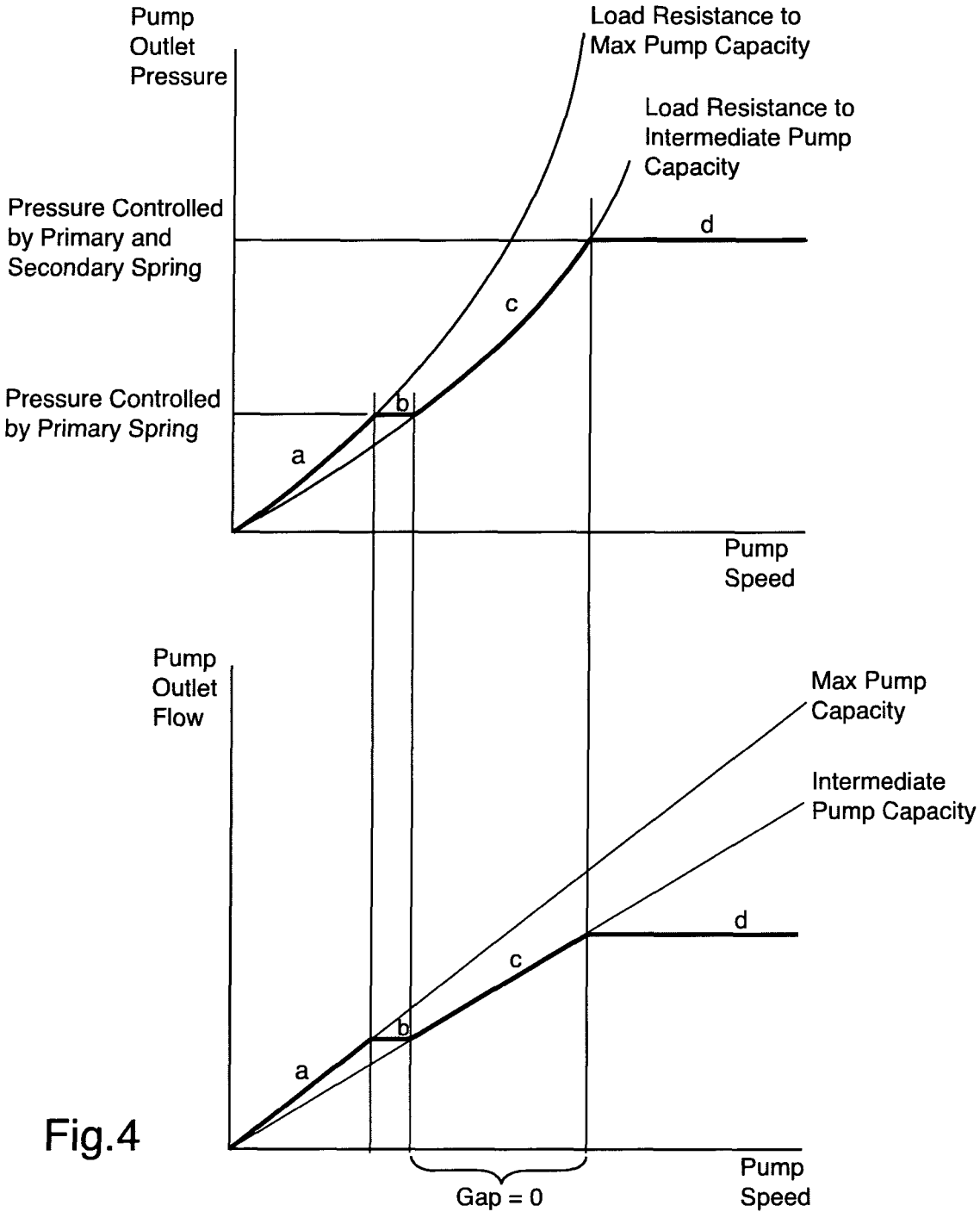
FIG. 4 is a graph illustrating performance of a variable capacity pump of FIG. 1.

Referring to FIG. 4, segment a is the performance of the pump 20 when eccentricity is at maximum position. The flow follows a fixed or maximum capacity line and the pressure follows a load resistance curve that relates to this fixed capacity.

Segment b represents when the pre-load of low rate spring 56 is overcome by the pressure acting on the control ring 44 and the control ring 44 first begins to pivot. The pressure and flow remain substantially constant according to the equilibrium between the pressure and the spring force of primary spring 56. The secondary tab 58 is not in contact with the high rate spring 62.

Segment c represents when the gap 64 closes to zero and the secondary tab 58 first comes into contact with the high rate spring 62, but the pressure in chamber 60 is not high enough to overcome the pre-load of secondary spring 62. The eccentricity therefore remains constant at this intermediate value, and the flow follows another (smaller) fixed capacity line. The pressure follows a new load resistance curve that relates to this lower value of pump displacement.

Segment d represents when the pressure acting in chamber 60 on the control ring 44 overcomes the pre-load of the high rate spring 62 and the control ring 44 again moves. The pump outlet pressure and flow remain substantially constant according to the equilibrium between the pressure in chamber 60 and the combined forces of springs 56 and 62. When the pressure of the pressurized working fluid in chamber 60 is not sufficient to overcome the combined biasing forces of return springs 56 and 62, pump control ring 44 pivots about pivot pin 52, in the clockwise direction to increase the eccentricity of pump 20.

The arrangement of the two springs has been illustrated as being in separate housings within casing 22. It is apparent to those skilled in the art that the two springs could be arranged in other configurations, including concentric springs within the same housing, without departing from the scope of the present invention.

The above-described embodiments of the invention are intended to be examples of the present invention and alterations and modifications may be effected thereto, by those of skill in the art, without departing from the scope of the invention which is defined solely by the claims appended hereto.

We claim:

1. A variable capacity vane pump having a pump control ring which is moveable to alter output capacity of the pump, the pump being operable at least two selected equilibrium pressures, comprising:

a pump casing having a pump chamber therein, the pump casing having an inlet port and an outlet port;

a vane pump rotor rotatably mounted in the pump chamber;

a control ring enclosing the vane pump rotor within said pump chamber, a plurality of vanes operatively engaging said rotor and frictionally engaging said control ring, defining a series of pumping chambers whereby driven rotation of said rotor effects drawing fluid into the pumping chambers through said inlet port and exhausting fluid out of the pumping chambers through said outlet port;

said control ring being moveable within the pump chamber to alter volumetric capacity of the series of pumping chambers;

a control chamber between the pump casing and the control ring, the control chamber operable to receive pressurized fluid to create a force to bias the control ring towards a position of minimum volumetric capacity of the pumping chambers;

a primary return spring acting between the control ring and the casing to bias the control ring towards a position of maximum volumetric capacity of the pumping chambers, the primary return spring acting against the force of the control chamber to establish a first equilibrium pressure; and a secondary return spring mounted in said casing and configured to engage said control ring after said control ring has moved a predetermined amount towards a position of minimum volumetric capacity, said secondary return spring biasing the control ring towards a position of maximum volumetric capacity, the secondary return spring acting against the force of the control chamber to establish a second equilibrium pressure.

2. The variable capacity vane pump according to claim 1, wherein said secondary return spring is pre-loaded.

3. The variable capacity cane pump according to claim 2, wherein said second equilibrium pressure is greater than said first equilibrium pressure.

4. The variable capacity vane pump according to claim 3, wherein said control ring pivots about a pivot pin.

* * * * *